United States Patent [19]

Bauck et al.

[11] Patent Number: 4,489,325

[45] Date of Patent: Dec. 18, 1984

[54] ELECTRONICALLY SCANNED SPACE FED ANTENNA SYSTEM AND METHOD OF OPERATION THEREOF

[76] Inventors: Jerald L. Bauck, 2834 S. Calle Rosa Cir., Mesa, Ariz. 85202; Sam Daniel, 921 E. Driftwood Dr., Tempe, Ariz. 85282

[21] Appl. No.: 528,767

[22] Filed: Sep. 2, 1983

[51] Int. Cl.[3] ..... H01Q 3/02; H01Q 3/12

[52] U.S. Cl. ..... 343/374; 343/376

[58] Field of Search ..... 343/373, 374, 375, 376, 343/754, 368, 371

[56] References Cited

U.S. PATENT DOCUMENTS

| | | | |
|---|---|---|---|
| 3,170,158 | 2/1965 | Rotman | 343/376 |
| 3,922,680 | 11/1975 | Alsberg et al. | 343/754 |
| 3,979,754 | 9/1976 | Archer | 343/374 |
| 4,085,404 | 4/1978 | Gallant | 343/376 |
| 4,186,398 | 1/1980 | Minnett et al. | 343/374 |
| 4,353,119 | 10/1982 | Daniel et al. | 364/517 |
| 4,388,626 | 6/1983 | Gans | 343/854 |
| 4,408,205 | 10/1983 | Hockman | 343/368 |

OTHER PUBLICATIONS

"Design of Monopulse Antenna Difference Patters with Low Sidelobes", E. T. Bayliss, The Bell System Technical Journal, May-Jun. 1968, pp. 623-650.

"Design of Line-Source Antennas for Narrow Beamwidth and Low Sidelobes", T. T. Taylor, IRE Transactions—Antennas and Propagation, Jan., pp. 16-28.

"Design Studies of Wide Angle Array Fed Lens", David T. Thomas, 1979, IEEE International Symposium Digest, Antennas and Propagation, pp. 340-343.

"Computer Aided Design of an Electronically Scanned Rotman Lens", K. P. Claborn, J. A. Gallant, R. E. Willey and A. I. Sinsky, 1977, IEEE VRSI AP-5 Int. Symp.; pp. 353-356.

"On the Correlation Between Wideband Arrays and Array Simulators", E. V. Byron and J. Frank, IEEE Transactions, Antennas and Propagation, Sep. 1968, pp. 601-603.

"Wide Angle Microwave Lens for Line Source Applications", W. Rotman and R. F. Turner, IEEE Transactions Antennas Propagation, vol. AP-11, pp. 623-632, Nov. 1963.

*Primary Examiner*—Theodore M. Blum
*Assistant Examiner*—Gregory C. Issing

[57] ABSTRACT

An E-scan, space fed antenna is realized using non-active radiation and excitation arrays and a reduced number of phase and amplitude shifters. The linear radiation array is coupled to the concave excitation array by a parallel plate lens. An optimization technique allows the choice of a subset of the excitation array and the calculation of the optimum complex weight for each activated element of the excitation array. An antenna design allowing 80° of scan and providing a maximum sidelobe level of better than −40 dB is disclosed which requires only 16 high resolution digital phase shifters and amplitude settings.

5 Claims, 17 Drawing Figures

ELECTRONICALLY SCANNED SPACE FED ANTENNA SYSTEM AND METHOD OF OPERATION THEREOF

FIELD OF THE INVENTION

The present invention relates, in general, to E-scan, space fed antennas. More particularly, the invention relates to an E-scan, space fed antenna system requiring no active elements associated with the radiation array. The present invention further relates to a method of optimizing the performance of such antennas.

BACKGROUND OF THE INVENTION

Phased array antennas are useful for providing high quality, electronically scanned beams. However, such antennas require the distribution of RF energy to a large number of elements in the array.

One solution to this problem is the space fed antenna wherein a second, usually smaller, array, the excitation array, radiates energy across a space after which it is coupled to and re-radiated by the primary, or radiation array. Thus, power distribution to the radiation array requires no direct physical connections.

Typically, each element of the radiation array in a space fed antenna is phase controlled, as in a phased array, and the radiation elements may also be amplitude controlled. In addition, it is sometimes necessary to apply phase and/or amplitude control to the excitation array elements. Thus, the number of high resolution phase shifters and amplitude settings required for an E-scan, space fed antenna can be quite large.

SUMMARY OF THE INVENTION

Accordingly, it is an object of the present invention to provide an improved E-scan, space fed antenna.

It is a further object of the present invention to provide an improved E-scan, space fed antenna having no active elements at the radiation array.

Yet a further object of the present invention is to provide an improved E-scan, space fed antenna requiring a minimum number of phase shifters and amplitude settings.

Another object of the present invention is to provide a method of designing and operating such an antenna so as to optimize its performance.

A particular embodiment of the present invention comprises an N element excitation array coupled to an L-element radiation array by means of a parallel plate lens. The radiation array is a linear array while the excitation array lies on a curve which is locally approximately circular, but with decreasing radius at the outer edges. In addition, the inter-element spacing in the excitation array is varied. An M element subset of the excitation array is coupled to the transmit/receive apparatus through a switching matrix, digitally controlled amplitude settings and phase shifters and a power distribution network. A look-up table receives an indication of the desired scan angle and provides inputs to the switching matrix and amplitude/phase shifters to select the proper subset of the excitation array and the optimum complex weight for each element. Fixed delay lines at the radiation array focus that array to a predetermined point.

This embodiment of the present invention further comprises a method of selecting the complex weight factors (amplitude and phase) to be applied to each excitation array element to optimize the illumination of the radiation array in a minimum mean square sense. The disclosed method is also suitable for optimizing the original design parameters of the antenna.

Using the techniques described below, it has been shown possible to design an antenna having a 142-element radiation array excited by a 16-element subset of the excitation array. The antenna has a scan range of 80° (±40° about center) with a maximum sidelobe level of −42 dB and a well formed main beam.

These and other objects and advantages of the present invention will be apparent to one skilled in the art from the detailed description below taken together with the drawings.

DETAILED DESCRIPTION OF THE INVENTION

Figure 1:
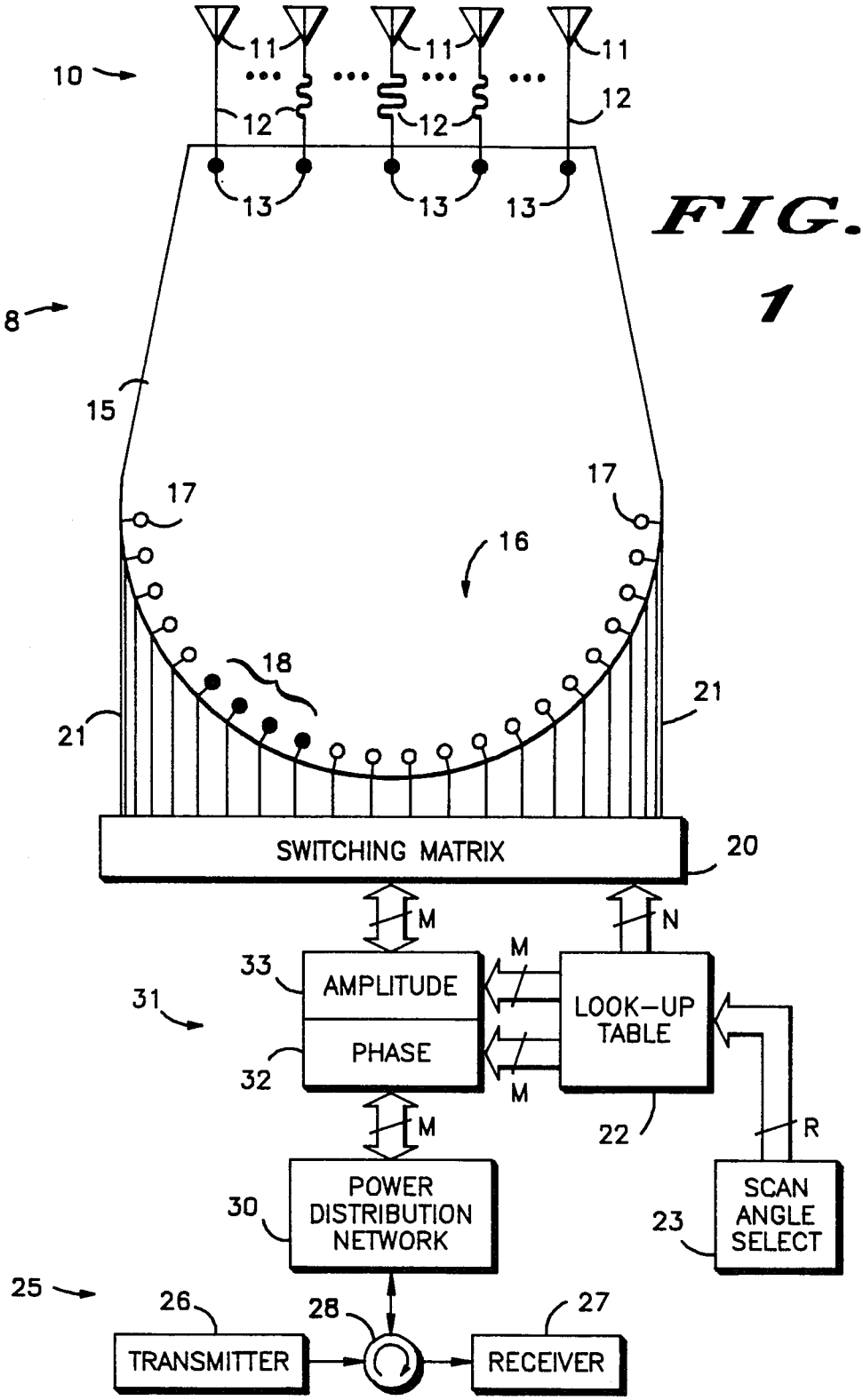
FIG. 1 is a block diagram of an E-scan, space fed antenna system according to the principles of the present invention.

Referring now to FIG. 1, the basic elements of an E-scan, space fed antenna 8 according to the principles of the present invention are described. A radiation array 10 comprises a linear array of radiating elements 11. The number of elements 11 in array 10 is L. In a preferred embodiment of the present invention L=142. Radiation array 10 is also commonly referred to as the aperture array. Each element 11 is coupled to one end of a delay line 12. As is discussed below, delay lines 12 are used to focus array 10 to a predetermined point. Delay lines 12 may be meander lines, lengths of coaxial cable or other suitable devices. The other end of each delay line 12 is coupled to a probe 13.

Probes 13 are arranged in a linear array across the front of a parallel plate lens 15. As is familiar in the art, a parallel plate lens is a broadband RF transmission device comprising two parallel conductive plates separated by a predetermined distance. The plates are bounded by an RF absorptive material to eliminate reflections. RF energy propagates between the plates in a TEM mode.

The edge of parallel plate lens 15 opposite probes 13 is a curve whose shape will be discussed below. Along this curve an array 16 of excitation elements 17 is arranged. The number of elements 17 in array 16 is N. However, only a subset 18 of array 16 is in use at any one time. The number of elements 17 in subset 18 is M. In a preferred embodiment of the invention, M=16.

Each element 17 in array 16 is coupled to a switching matrix 20 by means of an RF transmission line 21. Switching matrix 20 serves to couple the remainder of the system to the appropriate subset 18 of excitation array 16. In the preferred embodiment of the invention, switching matrix 20 provides M RF transmission paths of equal length. If the phase and/or amplitude characteristics of the various transmission paths are not identical, this may be accounted for in the mathematical model, as will be clear from the discussion below.

A look-up table 22 is coupled to switching matrix 20 and provides an N-bit digital word which activates switching matrix 20 to select the appropriate subset 18 of excitation array 16. As is apparent to one skilled in the art, a minimum of N switches is necessary to provide this function. A scan angle select device 23 is coupled to look-up table 22 and provides an R-bit digital word which selects the scan angle of antenna 8. In the preferred embodiment of the present invention, the scan range of the antenna is 80° (±40° about center) and the scan range is divided into 0.05° steps. Thus, 1600 scan angles are possible.

A transmit/receive apparatus 25 comprises a transmitter 26, a receiver 27 and a three-port circulator 28. Transmit/receive apparatus 25 is coupled by a single RF transmission line to a power distribution network 30. The purpose of power distribution network 30 is to divide the single signal supplied by transmit/receive apparatus 25 into M signals of equal amplitude and identical phase. One type of apparatus which is suitable for performing this function is a parallel plate lens similar to lens 15 in which a single excitation probe feeds M probes which are equidistant from the excitation probe. As will be more apparent from the discussion below, any amplitude and/or phase variations between the M signals produced by power distribution network 30 may be taken into account by the mathematical model.

Power distribution network 30 is coupled by M RF transmission paths to a complex weighting apparatus 31. Complex weighting apparatus 31 comprises M digital phase shifters 32 and M digital amplitude settings 33. Both phase shifters 32 and amplitude settings 33 are coupled to look-up table 22 by M digital lines. The resolution, or number of bits, of phase shifters 32 and amplitude settings 33 are chosen in consideration of the desired quality of performance of the antenna as a whole. Finally, complex weighting apparatus 31 is coupled to switching matrix 20 by M RF transmission paths.

In operation, scan angle select device 23 indicates the selected scan angle to look-up table 22. Look-up table 22 then configures switching matrix 20 to couple the appropriate subset 18 of excitation array 16 to complex weighting apparatus 31. In addition, look-up table 22 supplies the digital words to control the M phase shifters and M amplitude shifters of apparatus 31. Once this is done, transmit/receive apparatus 25 is coupled to radiation array 10. By virtue of the choices of the proper subset 18 of excitation array 16 and of the complex weight applied to each element, which choices are made according to a method detailed below, radiation array 10 produces the pattern chosen by scan angle select device 23.

In the preferred embodiment of the present invention, in which 1600 scan angles are possible and M=16, it requires 1600×2M, or 51,200, memory locations in look-up table 22 to store the complex weight factors to be supplied to apparatus 31. More memory is required to store the commands necessary to configure switching matrix 20. However, the total number of memory locations required is well within the state of the art of solid state memories. Furthermore, since all of the elements of the radiation and excitation arrays are non-active, that is to say that those elements do not include active phase shifters or amplitude settings, the number of expensive, digitally controlled phase shifters and amplitude settings could be reduced to an absolute minimum.

The phase and amplitude relationships between the elements of a linear array such as radiation array 10 which are necessary to provide a given radiation pattern are well known. For instance, see T. T. Taylor, "Design of Line-Source Antennas for Narrow Beamwidth and Low Side Lobe", *IRE Trans. Ant. Prop.*, Volume AP-3, pp. 16–28, January, 1955. Similarly, for monopulse difference patterns, see E. T. Bayliss, "Design of Monopulse Antenna Difference Patterns with Low Sidelobe", *Bell System Tech. J.*, Volume 47, pp. 623–650, May–June, 1968. Once the desired pattern of radiation array 10 is selected, the goal is to illuminate probes 13 with energy with the proper amplitude and phase relationships to obtain the intended pattern. This is accomplished by the selection of subset 18 of excitation array 16 and selection of the complex weight factors applied to each of the elements 17 within subset 18.

The first step in finding the appropriate complex weights to be applied to the excitation elements is to describe in detail the illumination of each of probes 13 by the combination of the activated excitation elements. To do this let l be an index indicating an element in radiation array 10. That is, $1 \leqq l \leqq L$. Similarly, m is an index indicating an element in subset 18 of excitation array 16 and $1 \leqq m \leqq M$. Now let $$E_l = \sum_{m=1}^{M} D_{lm}\alpha_m, \tag{1}$$

where $E_l$ is the total illumination of the lth element of radiation array 10, $D_{lm}$ is a factor including all of the phase and amplitude changes taking place between element m of the excitation array and element l of the radiation array and $\alpha_m$ is the complex weight assigned to element m of the excitation array. In other words, $\alpha_m$ is the combination of the phase shift and amplitude setting applied by apparatus 31 and by switching matrix 20, if any.

Now, the desired illumination pattern of radiation array 10 can be represented by $$e = \begin{bmatrix} e_1 \\ e_2 \\ \cdot \\ \cdot \\ \cdot \\ e_L \end{bmatrix}. \tag{2}$$

The elements of equation (1) can similarly be represented in matrix notation as $$D = [D_{lm}], \tag{3}$$

$$\alpha = \begin{bmatrix} \alpha_1 \\ \alpha_2 \\ \cdot \\ \cdot \\ \cdot \\ \alpha_M \end{bmatrix}, \tag{4}$$

and

-continued $$E = \begin{bmatrix} E_1 \\ E_2 \\ \cdot \\ \cdot \\ \cdot \\ E_L \end{bmatrix}. \quad (5)$$

Now equation (1) can be restated as $$E = D\alpha. \quad (6)$$

The goal is to derive $\alpha$ that maximizes the error $$\epsilon = D\alpha - e. \quad (7)$$

When a minimum mean square criterion is used to minimize the error, it can be shown that $$D^{*T}D\alpha - D^{*T}e = 0, \quad (8)$$

where the * represents the conjugate of the matrix and the T represents the transposition of the matrix.

Equation (8) may be restated as $$Cw + b = 0, \quad (9)$$

wherein C equals $D^{*T}D$, $w = \alpha$ and $b = -D^{*T}e$. Equation (9) may be solved by matrix inversion. However, in designing the preferred embodiment of the present invention, a Batch Covariance Relaxation technique, as is described in U.S. Pat. No. 4,353,119, was used. The result of this technique is to produce the vector $\alpha$ which describes the complex weight factors which must be applied to the selected subset of excitation array 16 for a given scan angle. However, before this technique can be used the elements $D_{lm}$ must be known precisely.

Figure 2:
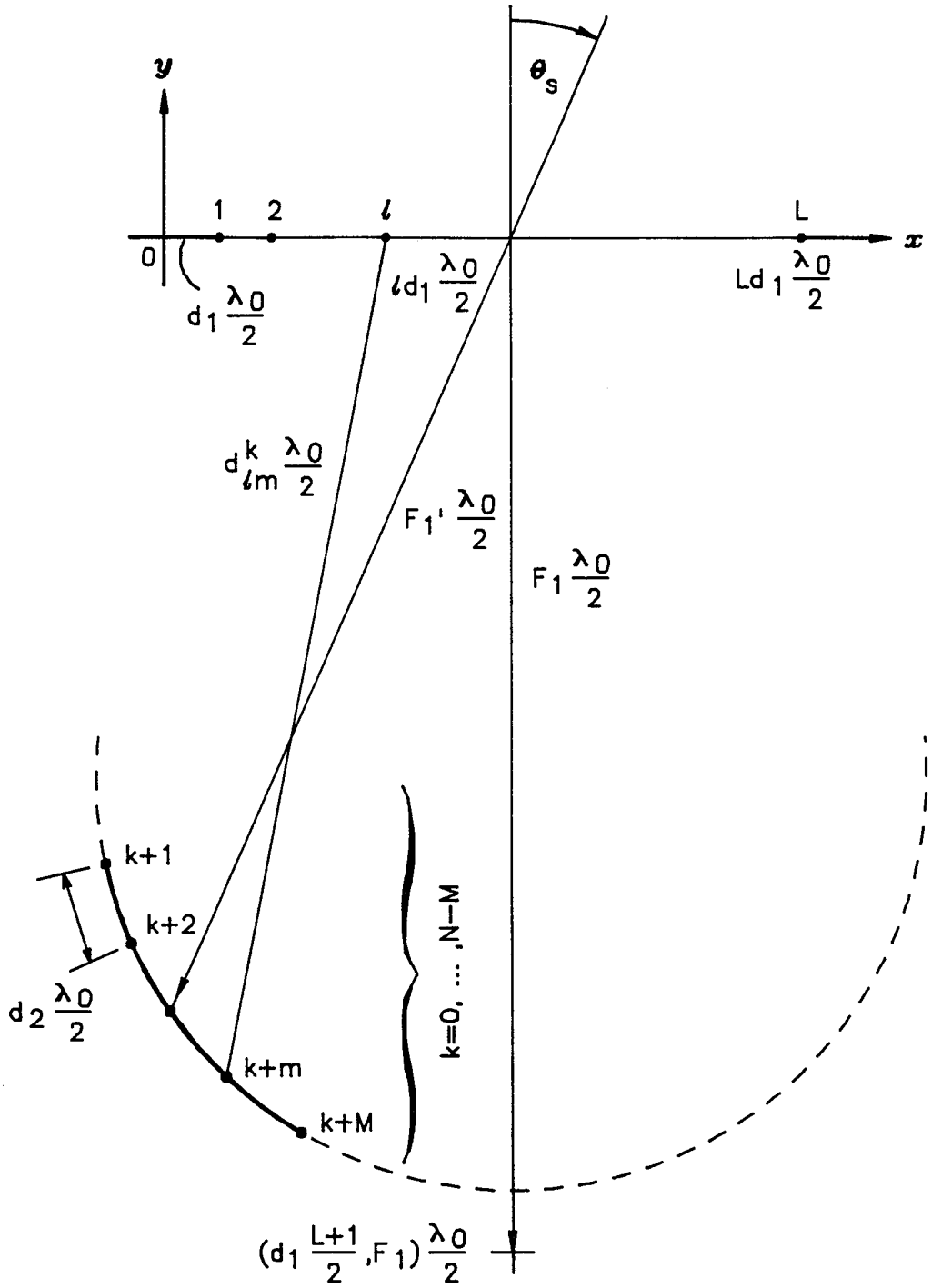
FIG. 2 is a geometric diagram of the elements of the antenna of FIG. 1.

Referring now to FIG. 2, the basic geometric relationships between the elements of the antenna of FIG. 1 are shown. The radiation array is defined as lying along an x-axis with an inter-element spacing of $d_1$, in units of one-half wavelength. Element 1 of the radiation array is one element spacing removed from the origin. As with all distances shown in FIG. 2, $d_1$ is in units of one-half wavelength at the center frequency of the antenna and FIG. 2 is shown in absolute distances. For simplicity, distances in the text will eliminate the one-half wavelength multiplier. The coordinate system used to define geometric relationships is completed by defining a y-axis as shown. The focal point of the radiation array, which is defined by the values of the fixed delay lines interposed between the probe elements and the radiation array elements, is at the location $$\left(d_1\left(\frac{L+1}{2}\right), -F_1\right).$$

Thus, $F_1$ is the focal length of the radiation array.

An initial selection of the appropriate subgroup of the excitation array for a given scan angle $\theta_s$ may be made by extending a line from the midpoint of the radiation array at an angle of $\theta_s$ with respect to the y-axis until it intersects the excitation array. A subset of the excitation elements extending M/2 on either side of the intersection point is the initial choice. This subset is designated by the index k. As is apparent, $0 \leqq k \leqq N-M$. The radius of curvature of the curve on which the excitation array lies is $F_1'$. As will be discussed below, this parameter need not be a constant over the entire curve.

The spacing of the elements in the excitation array is $d_2$. This parameter may also be varied over the excitation array to optimize the pattern. Finally, the distance between the l-th element of the radiation and the m-th element of the k-th subset of the excitation array is $d_{lm}^k$.

Once the basic parameters and geometric relationships have been defined, a mathematical model which will allow the calculation of the D and E matrices can be formulated. First, it is necessary to have a general expression for the illumination of the l-th element of the radiation array due to the m-th element of the excitation array.

$$h_{lm} = b_{lm}\exp[j2\pi f(t_l - t_{lm} + T_l)]. \quad (10)$$

In equation (10), f is a deviation about the center design frequency $f_0$. That is, $f = f_0 + f'$. Each of the other variables in equation (10) is discussed in detail below.

First of all, $t_l$ is the time advance, relative to the origin of the coordinate system for off-axis sources in azimuth and is given by $$t_l = \frac{ld_1}{2f_o}\sin\theta_s. \quad (11)$$

Next, $t_{lm}$ is the signal delay between the l-th and m-th elements and is given by $$t_{lm} = \frac{1}{2f_o}[(x_l - x_m)^2 + (y_l - y_m)^2]^{\frac{1}{2}}. \quad (12)$$

While the x and y positions of the l-th element are apparent from FIG. 2, those of the m-th element are slightly more difficult to express. Let the angle subtended by consecutive elements of the excitation array be $$\Delta = \frac{d_2}{L} \quad (13)$$

Next, let the angle between a line connecting the center of the radiation array to the m-th element and the y-axis be $$\theta_m = \theta_s + \left(\frac{M+1}{2} - m\right)\Delta \quad (14)$$

Equation (14) assumes that the excitation element at the center of the selected subset is at an angle of $\theta_s$ with respect to the vertical. Of course, this can be varied if that degree of freedom is desired. Finally, the x and y positions of the m-th element of the excitation array subset can be stated as $$x_m = \left(\frac{L+1}{2}\right)d_1 - F_1'\sin\theta_m, \quad (15)$$

and $$y_m = -F_1'\cos\theta_m. \quad (16)$$

Equations (15) and (16) consider the excitation array subset to be on a curve of radius of $F_1'$. Optimum illumination of the radiation array is obtained if the subset lies on a line facing the center of the radiation array. Simple adjustments can be made to the x and y positions to artificially insert this phase difference. On the other hand, if the adjustments are not made in the model, the optimization technique will add the necessary phase terms. The x and y positions calculated in equations (15) and (16) are used in equation (12) to provide the term $t_{lm}$.

The final time delay term of equation (10), $T_l$, represents the delay of the focusing delay lines between probes 13 and radiation array elements 11 of FIG. 1. This delay for the l-th element is given by $$T_l = \frac{\left[\left(\frac{L+1}{2} - l\right)^2 d_1^2 - F_1^2\right]^{\frac{1}{2}} - F_1}{2f_o}. \tag{17}$$

The final term of equation (10) to be defined is $b_{lm}$. This is a complex variable which includes the complex weight value $\alpha_m$, spatial attenuation between the excitation array and the probe elements, and the directional characteristics of the probes. That is, $$b_{lm} = \alpha_m b_r b_d, \tag{18}$$

where $b_r$ is the spacial attenuation and $b_d$ is the directional factor. Since the spacial attenuation is simply a $r^{-\frac{1}{2}}$factor, it can be shown that, after normalization by the shortest path, it can be expressed as $$r_4 = [F_1/d_{lm}]^{\frac{1}{2}}. \tag{19}$$

The directional factor $b_d$ does not seem to strongly influence the results of the model. However, the directionality factor used in the preferred embodiment of the present invention is $$b_d = \sin(f/f_o \pi D \cos\theta_{lm}) \cos^{\frac{1}{2}}\theta_{lm}, \tag{20}$$

where D is a parameter set to $0.62 \times \frac{1}{2}$ wavelength and $\theta_{lm}$ is the angle between the line joining the l-th and m-th elements and the y-axis.

It should be noted that the complex weighting factor $\alpha_m$ given in equation (18) is altered by any amplitude or phase differences in the RF transmission paths between the transmit/receive unit and the individual elements of the excitation array. This may be taken into account either by carefully matching all of the paths or by including amplitude and phase corrections in the model.

Now, each of the elements of equation (10) has been described in terms of the geometry of the antenna. Next, the summations over the l and m indices may be performed to obtain the illumination of the radiation array by the excitation array. In the preferred embodiment of the present invention, this was accomplished by computer. In fact, since the summation over the index l resembles an inverse discrete Fourier transform, the coefficients of which are determined by each of the summations over the index m, an inverse Fast Fourier Transform program was used. Of course, other numerical techniques are possible. The computer program was designed to accept as inputs the various parameters specifying the geometry of the antenna and to generate graphs indicating the illumination, in both phase and amplitude, of the excitation and radiation arrays and the far field pattern of the radiation array. In this way, the effects of varying the geometrical parameters of the antenna can be readily studied.

Referring now to FIGS. 3A–3E, the results of modeling an antenna according to the preferred embodiment of the present invention are shown. In specifying the desired pattern according to the Taylor paper cited above, the parameter $\bar{n}$ was set to 12 and the maximum sidelobe level was set to −50 dB relative to the main beam. The antenna is modeled operating at its center frequency at a scan angle of 0°. The focal length of the radiation array is 225, in half wavelength units. The radius of curvature of the excitation array subset is 205. The radiation element separation is 1.108 and the excitation array separation is 2.30. There are 142 elements in the radiation array and 16 elements in the active subset of the excitation array.

Figure 3A:
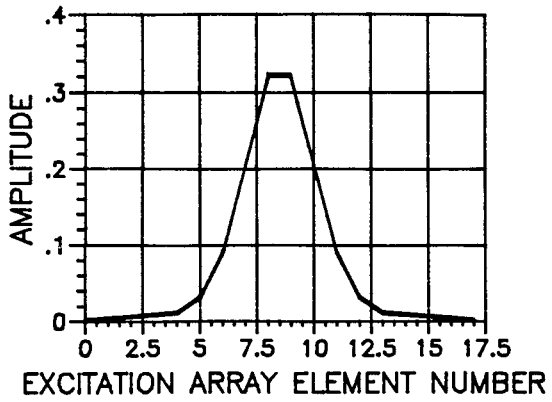
FIGS. 3A–E are graphs illustrating the operation of an antenna system according to the principles of the present invention at a scan angle of 0°.

FIG. 3A shows the amplitude weighting of the excitation array elements. As would be expected, the amplitude is greatest at the center of the subset and decreases evenly on either side thereof. In simulations in which one side of the subset was more strongly illuminated than the other, it was taken as an indication that the appropriate subset had not been chosen and the subset was moved in the direction of the more heavily weighted elements.

Figure 3B:
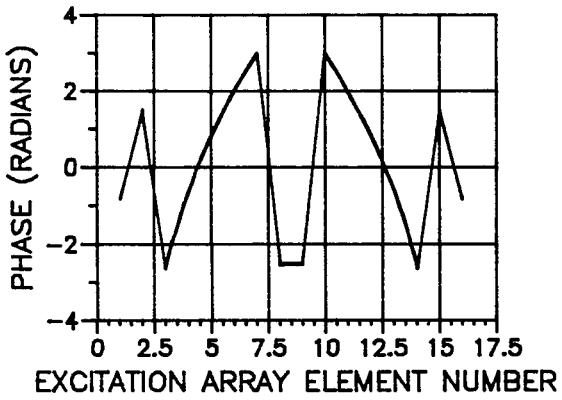

FIG. 3B illustrates the phase weighting of the elements of the excitation array subset. Together, FIGS. 3A and 3B completely describe the complex weight factors $\alpha_m$ which must be stored in the look-up table.

Figure 3C:
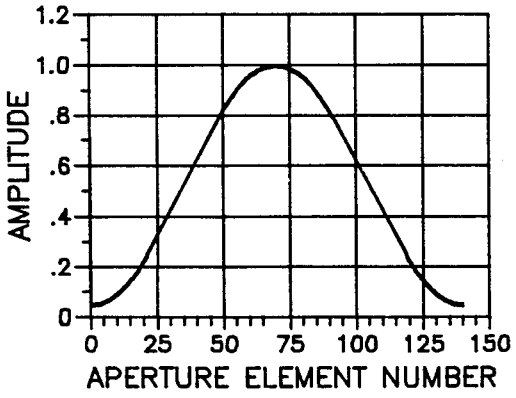
Figure 3D:
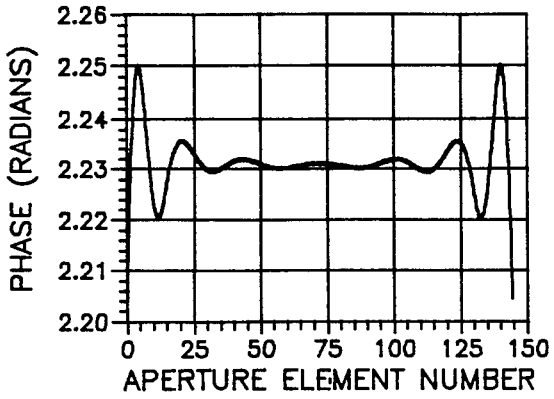

FIGS. 3C and 3D illustrate the amplitude and phase illumination of the aperture elements, or radiation array elements, and can be compared to the ideal illumination according to the Taylor paper cited above.

Figure 3E:
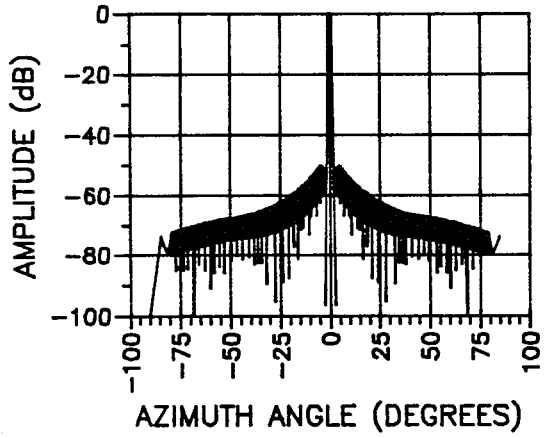
Figure 4A:
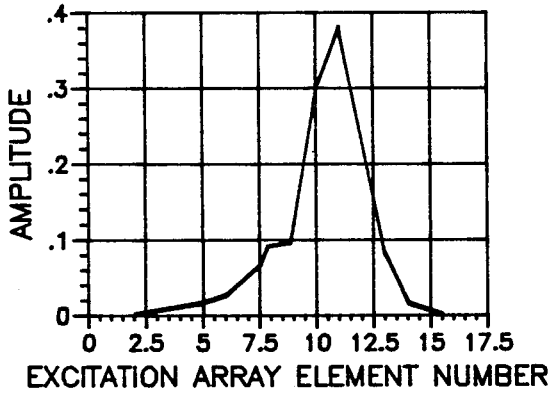
FIGS. 4A–E are graphs illustrating the operation of an antenna system according to the principles of the present invention at a scan angle of 20°.
Figure 4B:
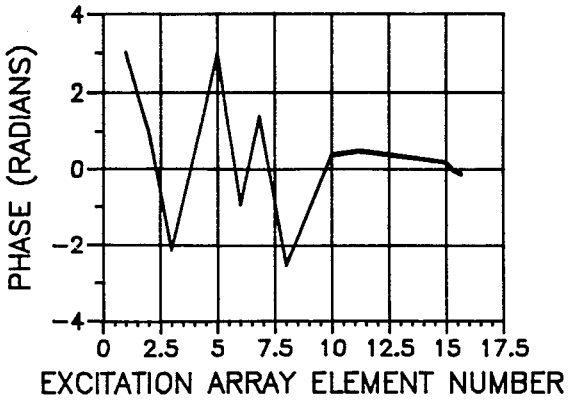
Figure 4C:
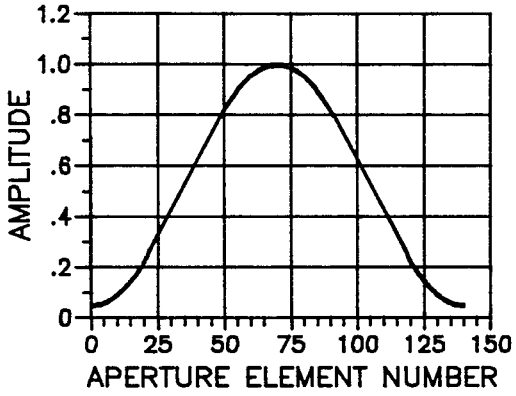
Figure 4D:
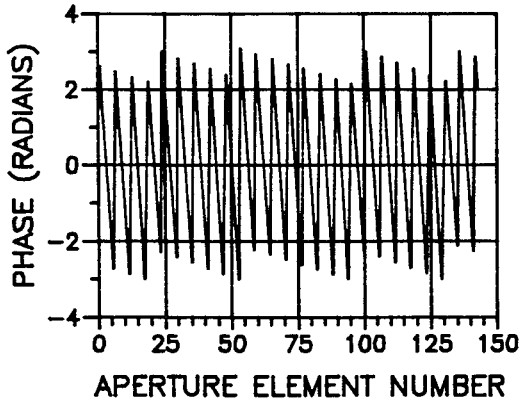
Figure 4E:
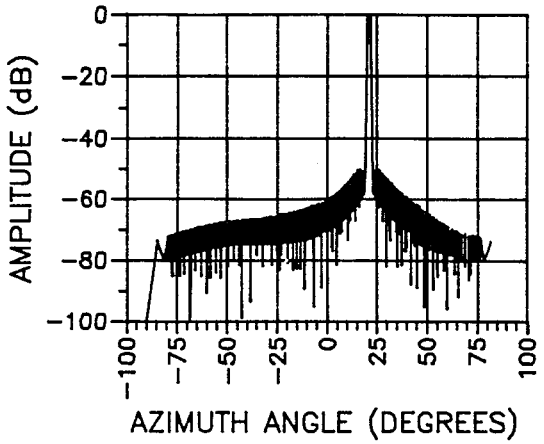
Figure 5A:
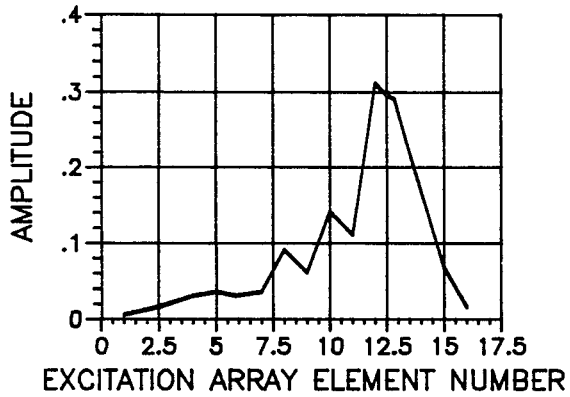
FIGS. 5A–E are graphs illustrating the operation of an antenna system according to the principles of the present invention at a scan angle of 40°.
Figure 5B:
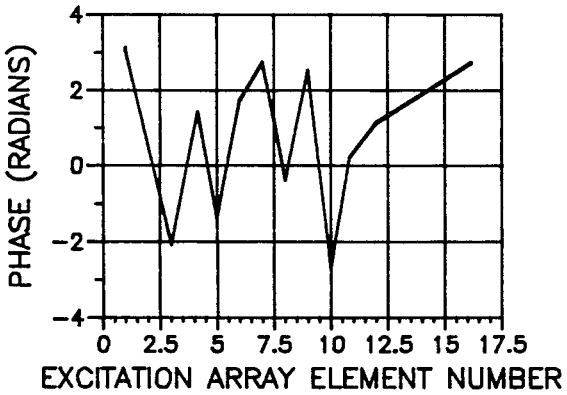
Figure 5C:
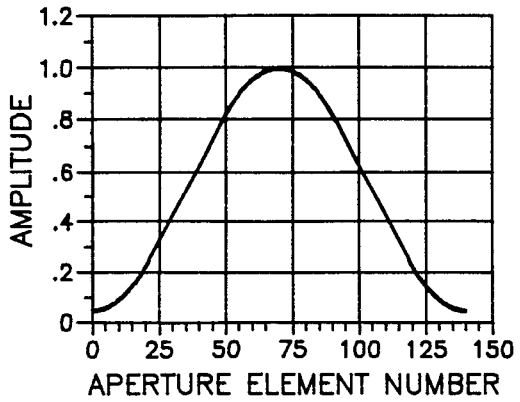
Figure 5D:
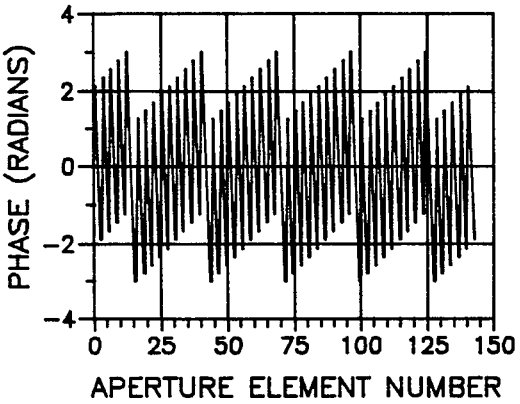
Figure 5E:
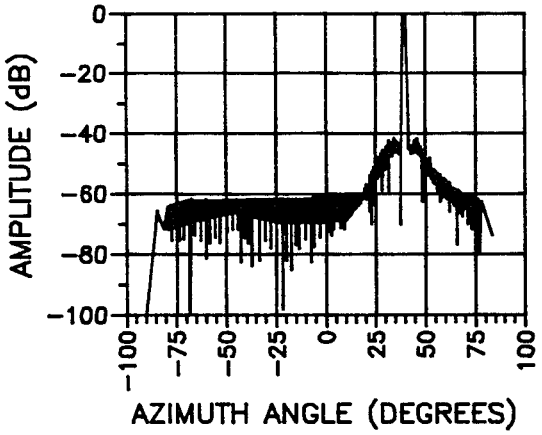

Finally, FIG. 3E shows the far field radiation pattern of the radiation array assuming a $\cos^{\frac{1}{2}}\theta$ pattern for each of the individual radiation array elements. As is apparent, the main beam of the radiation pattern is very narrow and well formed and the maximum sidelobe level is −50 dB.

Referring now to FIGS. 4A–4E, an antenna according to a preferred embodiment of the invention is shown operating at a scan angle of 20°. Again, the antenna is modeled at the center design frequency. The focal length of the radiation array is not altered, but the radius of curvature of the local segment of the curve upon which the active subset of the excitation array is located has been changed to 190. Also, the element spacing of the excitation array has been changed to 2.5. As can be seen from FIG. 4E, the main beam of the radiation pattern is only slightly broadened and the maximum sidelobe level is almost the same as when the scan angle was 0°.

Finally, referring to FIGS. 5A–5E, the performance of the antenna at a 40° scan angle is illustrated. The radius of curvature of the excitation array has been further shortened to 140 and the excitation array element spacing has been changed to 2.4. Again, the main beam of the radiation pattern is slightly broadened, but is still excellently formed and narrow enough for practical purposes. Furthermore, the maximum sidelobe level is still less than −40 dB.

Similar performance of the above described antenna has been shown to be obtainable for monopulse difference patterns according to the Bayliss reference.

An electronically scanned, space fed antenna system has been shown and described and a method of calculating the parameters needed to operate the antenna disclosed. As is apparent, this method of selecting the operating parameters of the antenna allows wide variation in many of those parameters to fit a particular need. While the parameters of a particular antenna providing excellent performance to a scan angle of ±40° have been specified, it is anticipated that further studies of the effects of variations in the various parameters and further refinements of the mathematical model may provide antenna designs offering even better performance for particular needs. An important advantage of the present invention is that an E-scan, space fed antenna can be realized utilizing a relatively small number of expensive, digitally controlled amplitude settings and phase shifters.

Among others, two important modifications may be made to the apparatus described above without departing from the scope of the present invention. First, look-up table 22 of FIG. 1 may be replaced with a computer which continuously matches the actual illumination of probes 13 to the desired illumination by changing the inputs to weighting apparatus 31. Second, if wide-band operation of the antenna is desired, it may be necessary to include a center frequency selection apparatus which adapts the weighting factors to the different frequencies.

We claim:

1. A method of operating an antenna system of the type having a radiation array and a spatially separated excitation array comprising the steps of:

selecting a desired set of amplitudes and phases necessary to cause the radiation array to create a desired radiation pattern;

selecting a subset of the excitation array;

formulating a description of actual amplitudes and phases of said radiation array in terms of amplitudes and phases of said subset of said excitation array;

determining an optimum set of amplitudes and phases of said subset which minimizes a mean square error between said actual amplitudes and phases and said desired amplitudes and phases; and controlling phase and amplitude characteristics of transmission paths between said selected subset of said excitation array and an apparatus utilizing the antenna to produce said optimum set of phases and amplitudes at said excitation array.

2. A method according to claim 1 wherein said step of selecting said subset further comprises the steps of:

identifying said desired radiation pattern as one of a stored set of patterns; and configuring a switching matrix according to a predetermined configuration associated with said one of said stored set of patterns.

3. A method according to claim 1 wherein said step of controlling said phase and amplitude characteristics further comprises the steps of:

identifying said desired radiation pattern as one of a stored set of patterns; and setting phase shifters and amplitude settings coupled between said subset of said excitation array and said utilization apparatus according to a predetermined pattern associated with said one of said stored set of patterns.

4. A method of operating an antenna system of the type having an excitation array, a radiation array, a parallel plate lens coupling the excitation and radiation arrays and a number of phase shifters and amplitude setters less than a number of elements in said excitation array comprising the steps of:

selecting a set of amplitudes and phases corresponding to a desired pattern of said radiation array;

selecting a subset of said excitation array having a number of elements equal to said number of phase shifters and amplitude setters;

generating a matrix whose elements describe the amplitude and phase of the illumination of each radiation array element by each excitation array element in said subset;

solving for a set of amplitudes and phases of said subset of excitation array elements which minimizes a means square error between said selected set of amplitudes and phases and an actual set of amplitudes and phases; and adjusting said phase shifters and amplitude setters to match the amplitudes and phases of said excitation array elements to said solved for amplitudes and phases.

5. A method according to claim 4 wherein said step of selecting said subset further comprises the steps of:

identifying said desired radiation pattern as one of a stored set of patterns; and configuring a switching matrix according to a predetermined configuration associated with said one of said stored set of patterns.

* * * * *